US005083767A

United States Patent [19]

Iwamoto et al.

[11] Patent Number: 5,083,767

[45] Date of Patent: Jan. 28, 1992

[54] SHEET SUPPLYING DEVICE

[75] Inventors: Ken-ichi Iwamoto; Yuuji Sugimoto, both of Nara; Kenji Okada, Ikoma; Tadasu Taniguchi, Kita-Katsuragi; Yoshikado Yamada, Kashihara; Toyoaki Namba, Nara, all of Japan

[73] Assignee: Sharp Kabushiki Kaisha, Osaka, Japan

[21] Appl. No.: 523,800

[22] Filed: May 15, 1990

[30] Foreign Application Priority Data

May 15, 1989 [JP] Japan ..... 1-121814
May 15, 1989 [JP] Japan ..... 1-121815
Jul. 25, 1989 [JP] Japan ..... 1-193467

[51] Int. Cl.[5] ..... B65H 3/52
[52] U.S. Cl. ..... 271/121; 271/162
[58] Field of Search ..... 271/10, 4, 117, 118, 271/121, 122, 162, 164, 114, 225, 902

[56] References Cited

U.S. PATENT DOCUMENTS 3,857,559 12/1974 McInerny .
3,961,786 6/1976 Yanker .
4,089,516 5/1978 Colglazier et al. .
4,709,911 12/1987 Saiki et al. .
4,822,023 4/1989 Miyoshi .
4,998,137 3/1991 Ida et al. .

FOREIGN PATENT DOCUMENTS 56-59245 5/1981 Japan .
59-123859 7/1984 Japan .
60-67836 8/1985 Japan .
61-192637 8/1986 Japan .
61-257843 11/1986 Japan .

*Primary Examiner*—David H. Bollinger
*Attorney, Agent, or Firm*—David G. Conlin; Robert M. Asher

[57] ABSTRACT

A sheet supplying device has at least one sheet stacking portion for stacking a plurality of sheets to be fed, a unit for drawing the sheets out of the sheet stacking portion to feed the drawn sheet to a predetermined path, and a unit for returning a sheet into the sheet stacking portion. This sheet is drawn by the drawing unit but stayed in a position that the leading edge thereof is out of the sheet stacking portion.

8 Claims, 13 Drawing Sheets

SHEET SUPPLYING DEVICE

BACKGROUND OF THE INVENTION

1. Field of the Invention

The present invention relates to a sheet supplying device for feeding sheets which are piled in a sheet stacking portion, such as a sheet cassette, a stacker and so on, to a predetermined transport path.

2. Description of the Related Art

In order to facilitate the sheet change operation to the utmost in a conventional copying machine, it is known that the copying machine is provided with a plurality of sheet cassettes, each of which sheet cassettes respectively contains a different type of sheet in regard to its size or feeding direction, mounted in a desk located under a main body of the copying machine. The copying machine automatically selects a desired type of sheet from any one of the sheet cassettes (Japanese Laid Open Patent Publication No. 61-192637).

In the above copying machine, a sheet supplying device for feeding the sheets piled in each cassette to a sheet supply path is mounted at an upper portion of the exit side of the cassette. Although the sheet supplying device feeds the sheets one by one, it sometimes double feeds the sheets under the influence of, for example, electrostatic adhesion of the sheets.

A sheet supplying device which has means to solve such a problem has already been proposed. For example, Japanese Laid Open Patent Publication No. 53-129648 discloses a sheet supplying device which is provided with a movable pad between a contact position and a non-contact position with a roller and feeds the sheets one by one by making the coefficient of the friction of the pad smaller than that of the roller.

However, the above-mentioned conventional sheet supplying device prevents a bottommost sheet of the sheets being simultaneously fed from being supplied and a portion of the bottommost sheet still remains out of the sheet cassette. In this case, since the portion of the sheet out of the sheet cassette comes into contact with the sheet supplying device when the cassette is drawn out of the desk to resupply new sheets or make recovery from sheet jam, the sheet is sometimes damaged by the contact.

Especially, if the sheet cassette is a rotatable sheet cassette capable of feeding the sheets in lateral and longitudinal directions, the above problem is serious. In other words, if a portion of the sheet is out of the sheet cassette as mentioned above, when the rotatable sheet cassette rotates to change the sheet feeding direction, the sheet is frequently damaged. Furthermore, the damage to the sheet may make the sheet supplying operation difficult.

SUMMARY OF THE INVENTION

It is an object of the present invention to provide a sheet supplying device which can prevent a sheet from being damaged in a sheet stacking portion, such as a sheet cassette, a stacker and so on.

According to the present invention, the above object can be achieved by providing a sheet supplying device which comprises a sheet stacking portion for stacking sheets to be supplied, a unit for drawing the sheets out of the sheet stacking portion to feed the drawn sheets to a predetermined path, and a sheet return unit for returning a sheet into the sheet stacking portion, which sheet is drawn by the drawing unit but stayed in a position that the leading edge thereof is out of the sheet stacking portion toward the supply direction.

The sheet stacking portion may be a sheet cassette.

This sheet cassette may be a rotatable casette which is rotatably mounted for switching the lateral sheet supply position and the longitudinal sheet supply position.

If the sheet stacking portion is a rotatable cassette, it is preferable that the sheet supplying device of the present invention further includes a control unit for actuating the sheet return unit before rotating the rotatable cassette.

In such an arrangement, the sheet has already been completely returned into the rotatable cassette when the rotatable cassette is rotated, and therefore the damage to the sheet is certainly prevented.

The sheet supplying device of the present invention may further comprise a control unit for actuating the sheet return means every time a predetermined sheet supply operation is completed.

The sheet return unit may have a sheet return plate for pushing the sheet back into the sheet stacking portion by pushing the leading edge of a sheet which is out of the sheet stacking portion toward the supply direction.

The drawing unit may have a roller which is in contact with the upper most sheet of the sheets piled in the sheet stacking portion and which rotates in a direction of drawing the contacted sheet out of the sheet stacking portion.

The sheet return unit is preferable to have a unit capable of rotating the roller in a direction opposite to the above drawing direction for a predetermined period of time and of keeping in contact with the sheet which is drawn by the drawing unit but stayed in a position that the leading edge thereof is out of the sheet stacking portion.

The sheet supplying device is preferable to further have a means for stopping the feed of a sheet not to be fed so as to prevent double feeding of the stacked sheets.

The sheet supplying device is preferable to still further have a feed roller movable between contact and non-contact positions with the stopping unit and a drive, unit capable of driving the feed roller so as to selectively contact with or separate from the stopping unit.

The sheet supplying device may further have a control means for actuating the sheet return unit after the feed roller separates from the stopping unit by the drive unit.

Further objects and advantages of the present invention will be apparent from the following description of the preferred embodiments of the invention as illustrated in the accompanying drawings.

DESCRIPTION OF THE PREFERRED EMBODIMENTS

Figure 1:
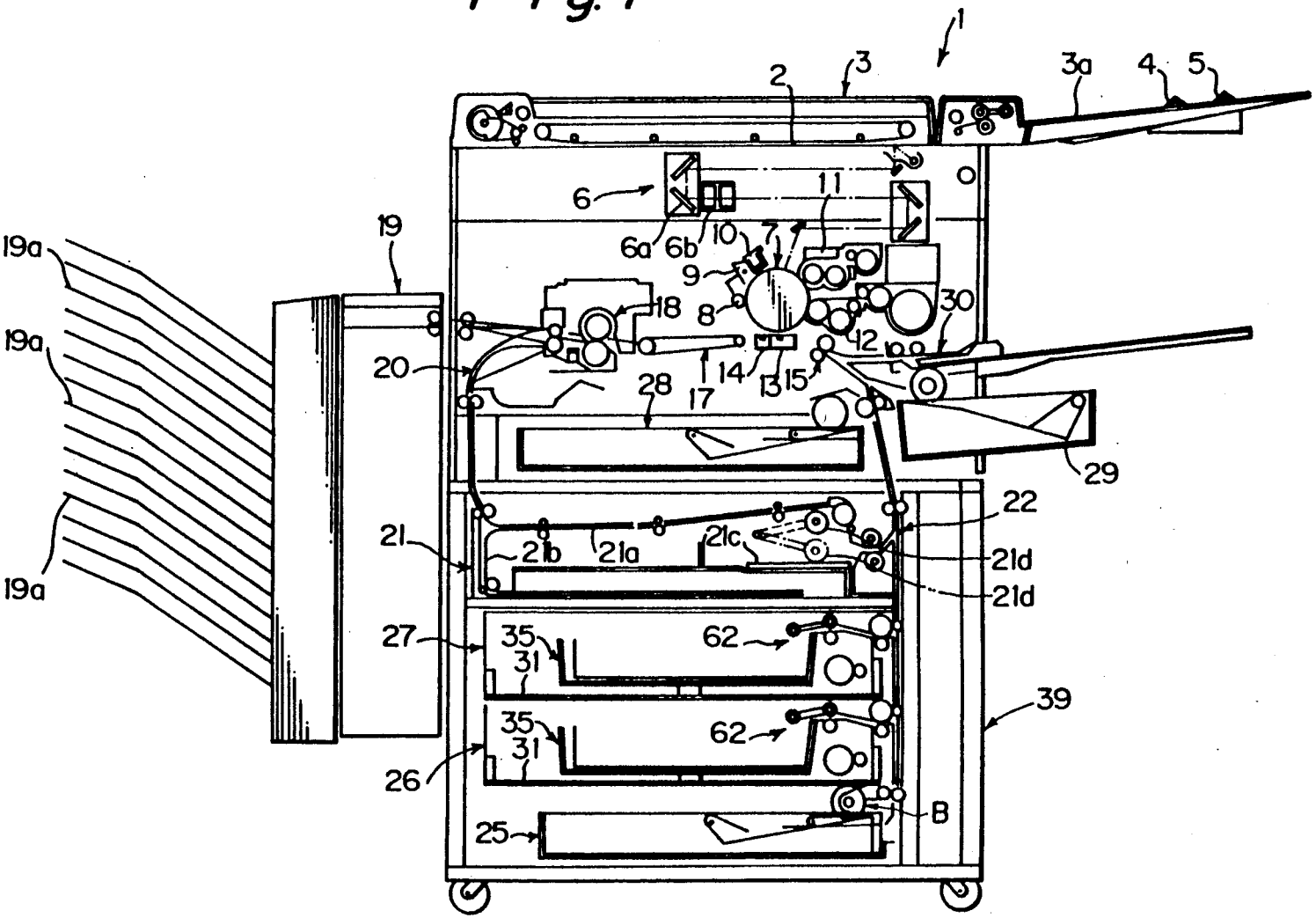
FIG. 1 is a schematic view showing the overall configuration of a copying machine provided with a sheet supplying device as a preferred embodiment of the present invention.

FIG. 1 schematically shows the overall configuration of a copying machine which is provided with a sheet supplying device of the present invention as a preferred embodiment of the present invention.

As shown in FIG. 1, an ADF (Automatic Document Feeder) 3 is mounted on a document platen glass 2 of a copying machine 1. The ADF 3 has a function for transporting a document, not shown, laid on a document tray 3*a* to a predetermined position on the document platen glass 2 according to its size or transport direction (a lateral or longitudinal transport direction) and for ejecting the document out of the ADF 3 after a copying operation is completed. Furthermore, if a double sided copy is performed, the ADF 3 a function for turning the document upside down, transporting the document to the predetermined position on the document platen glass 2 and ejecting the document out of the ADF 3 after the double sided copy is completed. On the document tray 3*a* mounted are switches 4 and 5 for judging the size of the document thereon.

Located below the document platen glass 2 is an optical system 6 which comprises a reflective mirror 6*a* and a lens 6*b*. The basic function of the optical system 6 is to direct a light reflected by the document to a photoconductor drum 7. Besides that, the optical system 6 has a variable power function, that is, it has a composition which enables magnification and reduction copy as well as equivalent magnification copy to be performed.

Around the photoconductor drum 7, are arranged a cleaner 8, a discharger 9, a charger 10, a developer 11 containing a toner for color development, and a developer 12 containing a black toner. As the photoconductor drum 7 rotates, a series of processes, that is, removing of remained toner, discharging, charging, exposing (by the optical system 6) and developing, are executed for the photoconductor drum 7.

Below the photoconductor drum 7, there is arranged a transfer charger 13 and a separating charger 14. When a copying sheet, not shown, passes between the photoconductor drum 7 and the transfer charger 13, a toner image formed on the photoconductor drum 7 is transferred onto the copying sheet by the transfer charger 13. The copying sheet is separated from the photoconductor drum 7 by the separating charger 14 and then the separated copying sheet is transported to a fuser 18 by means of a feed belt 17. The fuser 18 fuses the toner image which has been transferred on the copying sheet, by heat or pressure.

The copying sheet, which passes the fuser 18, is normally ejected onto sheet receivers 19*a* through a sorter 19 which is mounted outside the copying machine 1.

However, if a double sided copy or a synthesis copy is performed, the copying sheet is led to a sheet return path 20. In the double sided copy, the copying sheet is turned upside down and laid on an intermediate tray 21*c* after passing through a first sheet path 21*a* in a double sided and synthesis unit 21, and then is fed to a sheet supply path 22 by means of a feed-out roller 21*d*. On the other hand, in the synthesis copy, after the copying sheet is fed to a second sheet path 21*b* in the double sided and synthesis unit 21 and its ending edge is detected in the second sheet path 21*b*, the copying sheet is fed with the previous ending edge now being the leading edge in the forward direction. The fed copying sheet is laid upside down on the intermediate tray 21*c* after passing through the first sheet path 21*a*, and then, fed out to the sheet supply path 22 by means of the feed-out roller 21*d*.

The above mentioned sheet supply path 22 is a path for leading the copying sheet to the photoconductor drum 7. The path is provided with a paper stop roller 15 at the end portion thereof. This paper stop roller 15 is used to synchronize the leading edge of the copying sheet with the leading edge of the toner image on the photoconductor drum 7.

To the sheet supply path 22 are connected a plurality of sheet stacking portions mounted in a desk 39 and the copying sheet is properly supplied from each of the stacking portions. More concretely, the sheet stacking portions include a first fixed cassette 25, a first rotatable cassette unit 26, a second rotatable cassette unit 27, the double sided and synthesis unit 21, a second fixed cassette 28, a third fixed cassette 29 and a manual sheet supply portion 30 in this order from the side of the copying machine 1. The first fixed cassette 25, the second fixed cassette 28 and the third fixed cassette 29 are detachably mounted to the copying machine 1 and the first rotatable cassette unit 26 and the second rotatable cassette unit 27 are capable of being drawn together with their bedplates 31 out of the copying machine 1.

Figure 2:
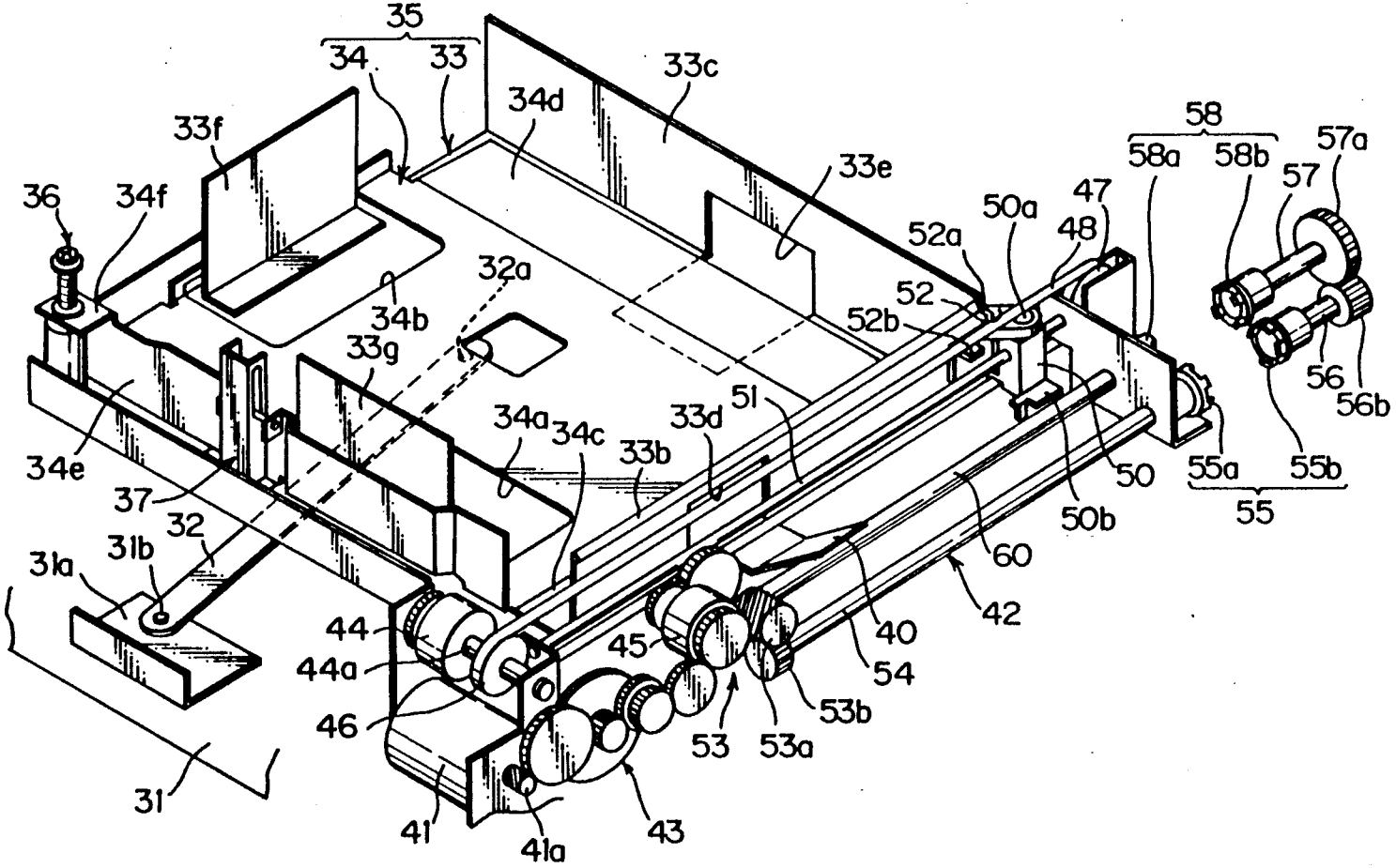
FIG. 2 is a schematic view of a rotatable cassette unit in the embodiment shown in FIG. 1.

FIG. 2 is a schematic perspective view of such a rotatable cassette unit and FIGS. 3*a* to 3*d* are top views showing the rotation process of the rotatable cassette.

As shown in FIG. 2, a pedestal 31*a* is fixed onto the bedplate 31 which is a portion of a housing of the rotatable cassette unit. One edge of an arm 32 is pivottaly supported by a support shaft 31*b* mounted on the pedestal 31*a*. Therefore, the arm 32 is rotatable and horizontally supported.

A support shaft 32*a* is mounted to the other edge of the arm 32, and thereby a rotatably cassette 35 is rotatably supported.

The rotatable cassette 35 has a double plate constitution of a sheet supply base 33 and a rotatable plate 34 laid on the sheet supply base 33. The lateral or longitudinal feed direction of the copying sheets piled on the rotatable plate 34 can be switched by rotating the rotatable cassette 35 by an angle of 90°. The position where the support shaft 32*a* pivottaly supports the rotatable cassette 35 is set so that the center of the copying sheet to be fed corresponds to the support shaft 32 in both the lateral and longitudinal sheet supply positions.

The sheet supply base 33 comprises a bottom plate 33*a* and wall portions 33*b* and 33*c* which are formed by folding a portion of the bottom plate 33*a* in order to prevent the displacement of the copying sheets. The wall portions 33*b* and 33*c* are mounted at the portions corresponding to the longitudinal and lateral feed exit portions of the rotatable plate 34. The wall portions 33*b* and 33*c* respectively have openings 33*d* and 33*e*. The openings 33*d* and 33*e* are elongated so as to intrude a predetermined length into the bottom plate 33*a* of the sheet supply base 33 toward its center and therethrough a lift plate 40 mounted under the sheet supply base 33 can abut against a back side of the bottom plate 33*a* of the rotatable plate 34 from below. The concrete arrangement of the lift plate 40 will be described below.

The sheet supply base 33 further comprises wall portions 33*f* and 33*g* arranged so as to correspond to the above-mentioned wall portions 33*b* and 33*c* respectively. The wall portions 33*g* and 33*f* are respectively located so as to pierce through openings 34*a* and 34*b* formed on the rotatable plate 34, thereby preventing the lift operation of the longitudinal and lateral exit portions of the rotatable plate 34 from being interfered with by the wall portions 33*g* and 33*f*.

On the rotatable plate 34, is formed a portion 34*c* which inclines forward at the longitudinal feed exit portion and a portion 34*d* which inclines forward at the lateral feed exit portion.

A support strip 34*f*, which projects outward from the top edge of the wall portion 34*e* of the rotatable plate 34, is mounted at a corner of a non-exit portion of the rotatable plate 34. A support mechanism 36 for supporting the rotatable plate 34 on a point is attached to the support strip 34*f*.

A guide member 37 is positioned a little apart toward the longitudinal feed exit portion from the support mechanism 36 at the non-exit portion of the rotatable cassette 35. The guide member 37 guides the rotatable plate 34 when the longitudinal feed exit portion of the rotatable plate 34 is lifted, and further functions as a rotation pivot of the rotatable plate 34 when the lateral feed exit portion of the rotatable plate 34 is lifted.

The rotatable cassette unit is provided with a drive mechanism 42 which performs the 90° rotational drive of the rotatable cassette 35 and the rotational drive of the lift plate 40 for the sheet lift-up operation by a single drive motor 41. In the drive mechanism 42, a gear 41*a* is fixed to the output shaft of the drive motor 41 and engagew with a group of gears 43. Thereby, the driving force of the drive motor 41 is transmitted to a first clutch 44 and a second clutch 45.

The first clutch 44 is intended to intermit the transmission of the driving force that rotates the rotatable cassette 35 through an angle of 90° and is located on the side of the drive mechanism 42. A pulley 46 is fixed to the output shaft 44*a* of the first clutch 44 and a pulley 47 is arranged on the other side of the drive mechanism 42. An endless belt 48 is passed over the pulleys 46 and 47.

A moving block 50 is fixed to a predetermined position of the belt 48 which passes under the pulleys 46 and 47. The moving block 50 reciprocates, accompanying the movement of the belt 48. The near center portion of the moving block 50 is provided with a pierced hole through which a guide shaft 51 for linearly guiding the moving block 50 is penetrated. The guide shaft 51 is elongated vertically to the sheet feed direction between the pulleys 46 and 47.

A support shaft 50*a* is formed on the upper portion of the moving block 50 and a hold member 52 is rotatably supported to the support shaft 50*a*. As is more clearly shown in FIG. 3*a*, the hold member 52 comprises an L-shaped angle 52*a*. The angle 52*a* is fixed to the corner between the longitudinal and lateral feed exit portions of the sheet supply base 33.

Position detector switches 100 and 101 are respectively mounted adjacent to both ends of the guide shaft 51 (See FIGS. 3*a* to 3*d*). The position detector switch 100 is operated by being pressed by an arm 52*b* mounted on the angle 52*a* for operating the switch. The position detector switch 101 is actuated by being pressed by an arm 50*b* of the moving block 50.

The second clutch 45 is intended to intermit the transmission of the driving force that lifts the sheets piled on the rotatable plate 34. The output of the second clutch 45 is transmitted to a rotatable shaft 54 through a group of gears 53. In other words, the output of the second clutch 45 is transmitted from each gear of the group to a worm gear 53*a*, transmitted to a wheel gear 53*b* which engages with the worm gear 53*a* and thereby transmitted to the rotatable shaft 54 which crosses the output shaft of the second clutch 45 in three dimensions.

One joint member 55*a* of a first coupling 55 is fixed to one end of the rotatable shaft 54 and the other joint member 55*b* of the first coupling 55 is fixed to a leading end of a rotatable shaft 56 which is rotatably supported by the main body of the copying machine I. Furthermore, a gear 57*a* fixed to a rotatable shaft 57 is engaged with a gear 56*b* fixed to a rotatable shaft 56. The rotatable shaft 57 is in parallel with the rotatable shaft 56 and rotatably supported by the main body of the copying machine 1 in the same manner as is the rotatable shaft 56. One joint member 58*b* of a second coupling 58 is fixed to the leading end of the rotatable shaft 57. The other joint member 58*a* of the second coupling 58 is fixed to one end of a lift-up shaft 60 mounted in parallel with the rotatable shaft 54. The connection and disconnection of the joint members 55*a* and 55*b* of the first coupling 55 and of the joint members 58*a* and 58*b* of the second coupling 58 is performed by drawing the rotatable cassette 26(27) in and out of the copying machine 1.

When the rotatable cassette 26(27) is drawn out of the main body of the copying machine 1 in order to resupply new copying sheets and so on, the above-mentioned couplings 55 and 58 are disconnected with the drive mechanism 42, the lift-up shaft 60 is freed, and then the lift plate 40 and the rotatable plate 34 descend by their own weight.

The lift plate 40 is fixed to the near center portion of the lift-up shaft 60. The lift plate 40 turns in correlation to the rotation of the lift-up shaft 60 to lift up the sheet feed exit portion of the rotatable plate 34. Furthermore, the second coupling 58 and the other end of the lift-up shaft 60 are merely rotatably supported without being connected with any other member.

An arm 60*a*, for operating a switch (see FIGS. 3*a* to 3*d*), is fixed to a predetermined position of the lift-up shaft 60 and a lift detector switch 61, which is turned ON/OFF by the arm 60*a*, is located adjacent to the arm 60*a*.

Figure 4A:
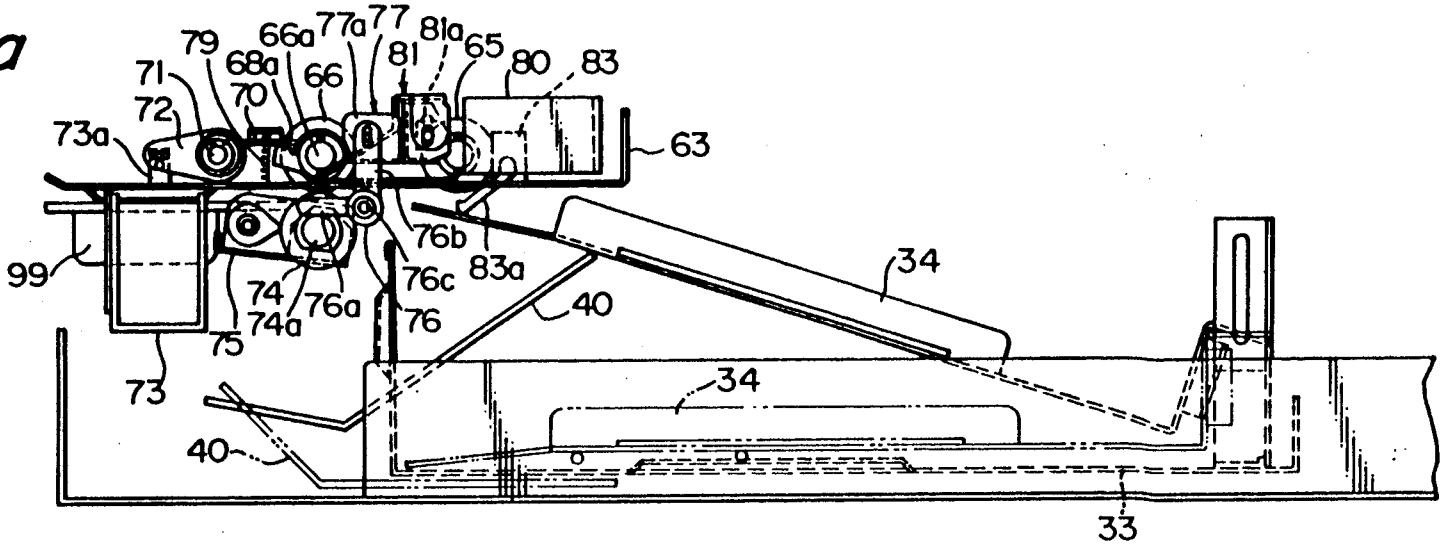
FIGS. 4*a* and 4*b* are schematic views showing the operation states of the rotatable cassette unit and a sheet supply mechanism shown in FIG. 2.
Figure 4B:
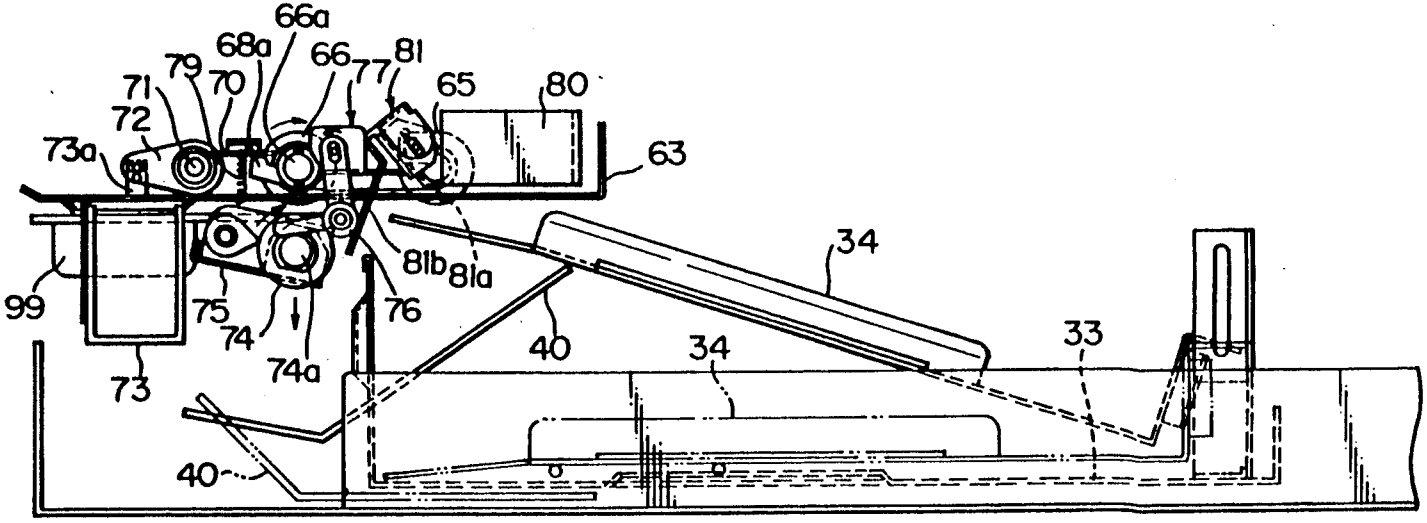
Figure 5:
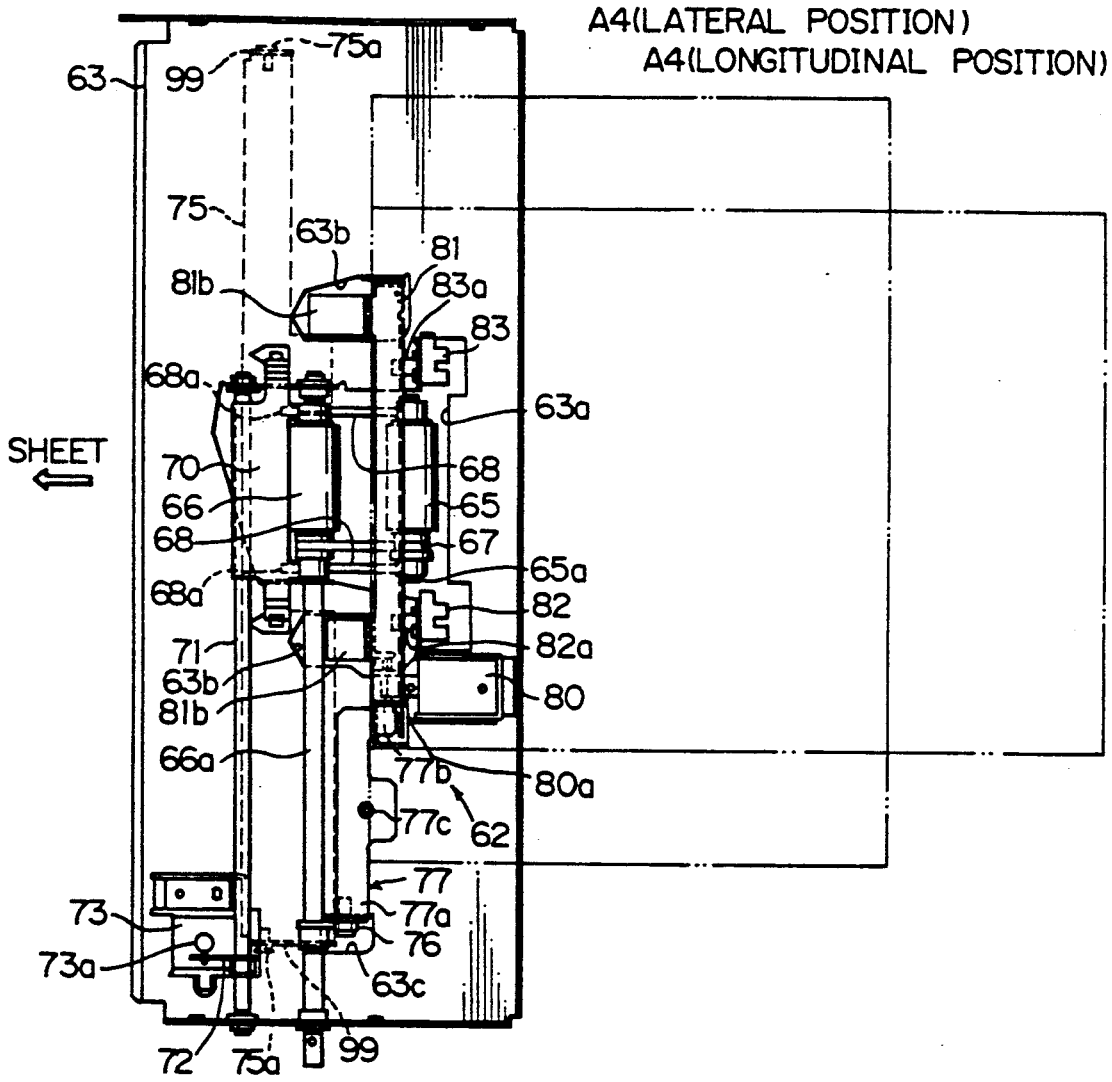
FIG. 5 is a top view of the sheet supply mechanism shown in FIGS. 4*a* and 4*b*.

FIGS. 4*a* and 4*b* are side views respectively showing the operation state of the rotatable cassette unit 26(27) and a sheet supply mechanism 62 (see FIG. 1) which is mounted above the sheet feed exit portion thereof. FIG. 5 is a top view of the sheet supply mechanism 62.

As shown in FIGS. 4*a*, 4*b* and 5, above the sheet feed exit portion of the rotatable cassette 35, a support base 63 is fixed to the main body of the copying machine 1 and provided with the sheet supply mechanism 62 for feeding the copying sheet to the sheet supply path 22.

Formed in the support base 63 are an opening 63*a* through which portions of a pull-in roller 65 and a feed roller 66 of the sheet supply mechanism 62 project from below the support base 63, an opening 63*b* through which a portion of a sheet return plate 81 projects from below the support base 63 and an opening 63*c* through which a portion of a press contact release lever 76 projects from below the support base 63.

The pull-in roller 65 of the sheet supply mechanism 62 is positioned above the sheet feed exit portion of the rotatable cassette 35. The feed roller 66 is arranged in parallel with and a predetermined distance in the sheet supply direction apart from the pull-in roller 65. The pull-in roller 65 and the feed roller 66 rotate in the same direction by means of an endless belt 67 which passes over one end of the rollers 65 and 66.

A pair of roller arms 68 lie laterally between a support shaft 65*a* for rotatably supporting the pull-in roller 65 and a rotatable shaft 66*a* for transmitting the rotation force to the feed roller 66 so as to put both rollers 65 and 66 between the pair of roller arms 68. By turning the pair of roller arms 68 on the rotatable shaft 66*a* as a pivot, the pull-in roller 65 is lifted up and down and therefore respectively separated from and abutted against the copying sheet.

The use of such a pull-in roller can make the sheet supply mechanism thinner than the use of, for example, a semicircular roller adopted at the sheet feed exit portion B of the first fixed cassette 25 shown in FIG. 1. For example, a cassette with a semicircular roller has a thickness of 140 mm. On the contrary, a cassette with a pull-in roller has a thickness of 110 mm, that is, about 30% thinner than the cassette with the semicircular roller. If the sheet supply mechanism 62 is thinner, the desk 39 can be smaller or the number of the copying sheets piled in the cassette or the number of cassettes mounted in the desk 39 can be increased without making the desk 39 bigger.

A projection 68*a* is formed at an end of each roller arm 68 on the side of the feed roller 66. The projection 68*a* is pressed downward by an angle 70 and thereby the roller arm 68 is turned upward. Between the angle 70 and the support base 63 is mounted a spring 79 (see FIGS. 4*a* and 4*b*), by which the angle 70 is urged toward the direction for pressing the projection 68*a* down. The angle 70 is fixed to one end of a shaft 71 and rotates in correlation to the rotation of the shaft 71.

An arm 72 is fixed to the other end of the shaft 71. A plunger 73*a* of a solenoid 73 is engaged with an elongated hole formed at a leading portion of the arm 72. The forward and backward movement of the plunger 73*a* is transmitted to the shaft 71 through the arm 72 and thereby rotates the shaft 71.

As shown in FIG. 4*a*, an attachment plate 75 is mounted below the feed roller 66. The attachment plate 75 is provided with a reverse roller 74 which rotates in the same direction (clockwise) as the rotational direction of the feed roller 66 in order to manage to return the copying sheet. The coefficient of friction of the roller surface of the reverse roller 74 is set smaller than that of the feed roller 66. Therefore, when the copying sheets are pulled one by one out of the rotatable cassette 34, the pulled copying sheet can be transported in the sheet feed direction, and in double feeding, in which two sheets are simultaneously pulled out, the under sheet is prevented from being transported.

Shafts 75*a* (see FIG. 5) mounted at both ends of the attachment plate 75 are supported by a paper guide 99 and thereby the attachment plate 75 is rotatable on the shafts 75*a*. Furthermore, the reverse roller 74 is pressed against and separated from the feed roller 66 by the rotation. The attachment plate 75 is urged toward the direction for pressing the reverse roller 74 against the feed roller 66 by means of a spring, not shown.

The reverse roller 74 is engaged with a rotatable shaft 74*a*, which transmits the rotational force thereto through a spring friction member, not shown. Thereby, when rotation friction above a fixed value is applied to the reverse roller 74, the driving force of the rotational shaft 74*a* is not transmitted to the reverse roller 74 and the rotation of the reverse roller 74 is stopped. The rotatable shaft 74*a* is arranged in parallel with and under the feed roller 66.

A leg 76*a* of an almost L-shaped lever 76 is located between the rotatable shafts 66*a* and 74*a*. The lever 76 is rotatably mounted on its shaft 76*c*. When the lever 76 turns counterclockwise, the leg 76*a* presses the rotatable shaft 74*a* and separates the reverse roller 74 from the feed roller 66.

The other leg 76*b* of the lever 76 is connected to an end 77*a* of a connecting member 77. The connecting member 77 turns on 77*c* (see FIG. 5) in a horizontal plane, thereby turning the lever 76. The other end 77*b* of the connecting member 77 is connected to a pin of a plunger 80*a* of a solenoid 80 for returning the sheet. The forward and backward movement of the plunger 80*a* enables the above-mentioned turning of the connecting member 77.

Furthermore, a sheet return plate 81 for returning the copying sheet into the rotatable cassette 35 is connected to the plunger 80*a* of the solenoid 80 and is turnable on a shaft 81*a* which is located between the feed roller 66 and the solenoid 80 above the pin of the plunger 80*a*. The sheet return plate 81 is provided with tongue portions 81*b* which extend to the vicinity of nip portions of both rollers 66 and 74 on both sides of the feed roller 66. The tongue portions 81*b* operates to push the leading edge of the sheet, which has been prevented from being transported by the operation of the feed roller 66 and the reverse roller 74, and return the sheet to the rotatable plate 34.

Figure 6:
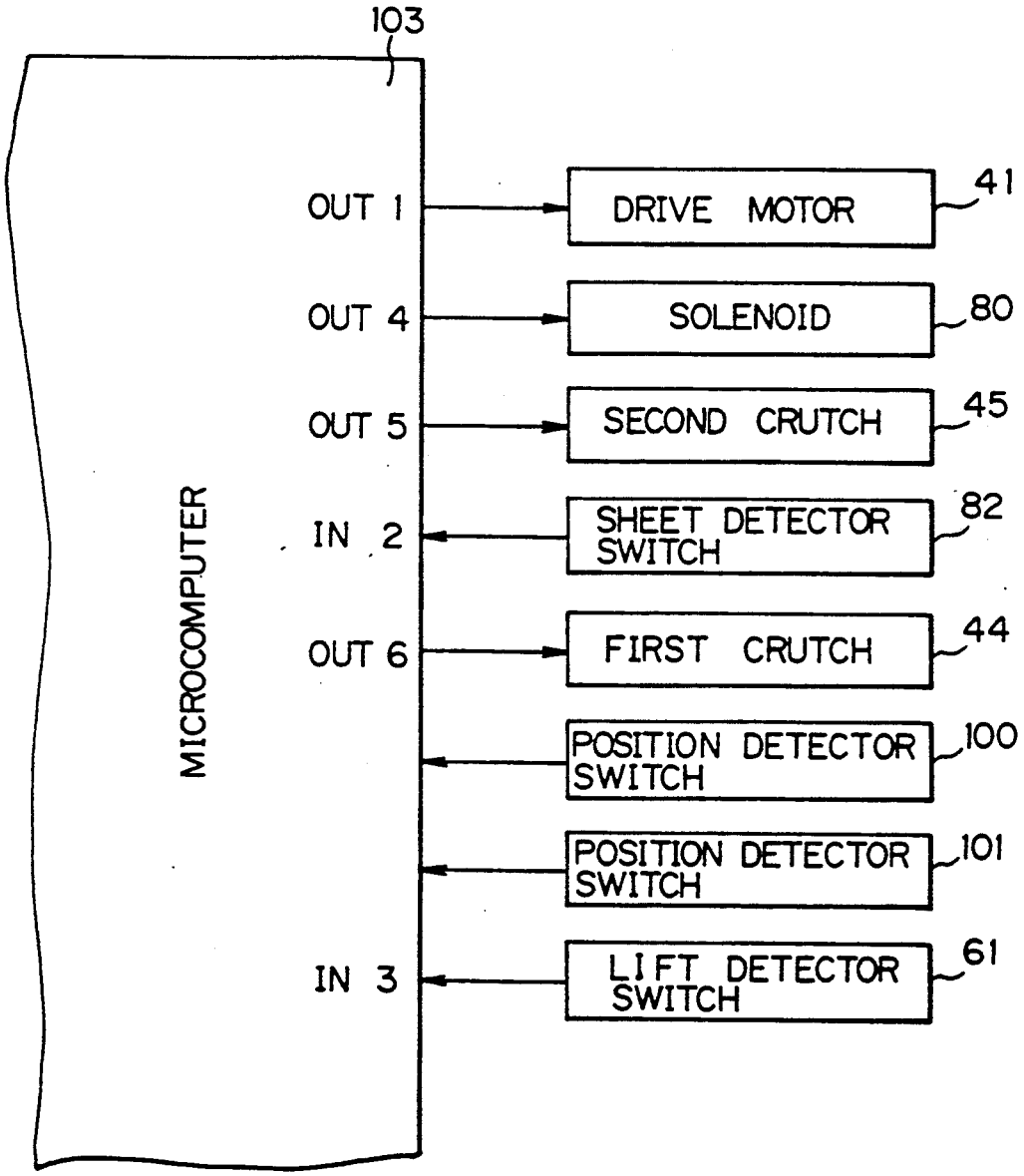
FIG. 6 is a schematic diagram of the electric composition of the embodiment shown in FIG. 1.

As shown in FIG. 6, a microcomputer 103 is connected to the solenoid 80 which drives the above sheet return plate 81 and the lever 76.

The microcomputer 103 controls the whole copying machine 1. In addition, when a rotation signal of the rotatable cassette 35 is produced, the microcomputer 103 actuates the above-mentioned solenoid 80 at least to release the lever 76 from pressing against the sheet and to make the sheet return plate 81 push back the sheet, in advance of the rotation operation of the rotatable cassette 35.

A sheet detector switch 82 and a sheet empty detector switch 83 are respectively arranged on the support base 63 and on both sides of the pull-in roller 65. The switches 82 and 83 are respectively provided with arms 82*a* and 83*a* which extend below the support base 63 through the opening 63*a* of the support base 63. These arms 82*a* and 83*a* are pushed by the sheet feed exit portion of the rotatable plate 34 being lifted up and thereby the switches 82 and 83 are actuated. At each of the longitudinal and lateral feed exit portions, an opening, not shown, is formed at a position corresponding to the arm 83*a* of the sheet empty detector switch 83. Therefore, since the arm 83*a* passes through the opening when no sheet is on the rotatable plate, the sheet empty detector switch 8 is not turned ON, while only the sheet detector switch 82 is turned ON. On the other hand, when the copying sheets are piled, both detector switches 82 and 83 are turned ON.

As shown in FIG. 6, besides the solenoid 80, the drive motor 41, the first and second clutches 44 and 45, the detector switch 82, the position detector switches 100 and 101 and the lift detector switch 61 are connected to the microcomputer 103.

The operation of the present embodiment will be described hereinafter.

First, the movement operation of the rotatable cassette 35 from a lateral position to a longitudinal position will be explained in reference to FIGS. 3*a* to 3*d*.

FIG. 3 shows the lateral position of the rotatable cassette 35. In the lateral position, the lateral exit portion of the rotatable cassette 35 is positioned on the side of the sheet exit of the rotatable cassette unit 26(27). In this state, the moving block 50 and the hold member 52, which compose a moving means, are positioned at one end of the guide shaft 51.

Figure 3A:
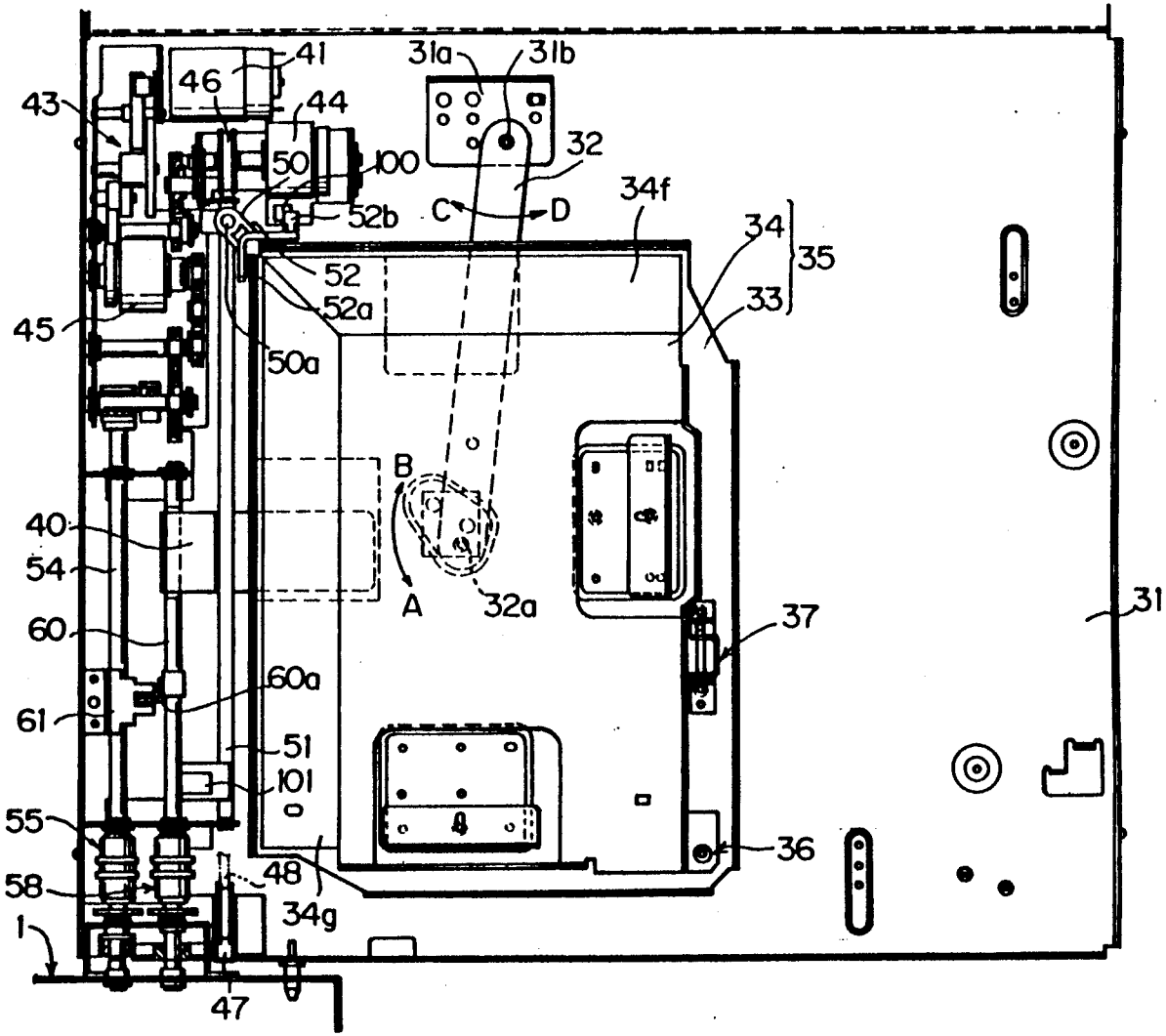
FIGS. 3*a* to 3*d* are views respectively showing a rotation process of the rotatable cassette unit shown in FIG. 2.
Figure 3B:
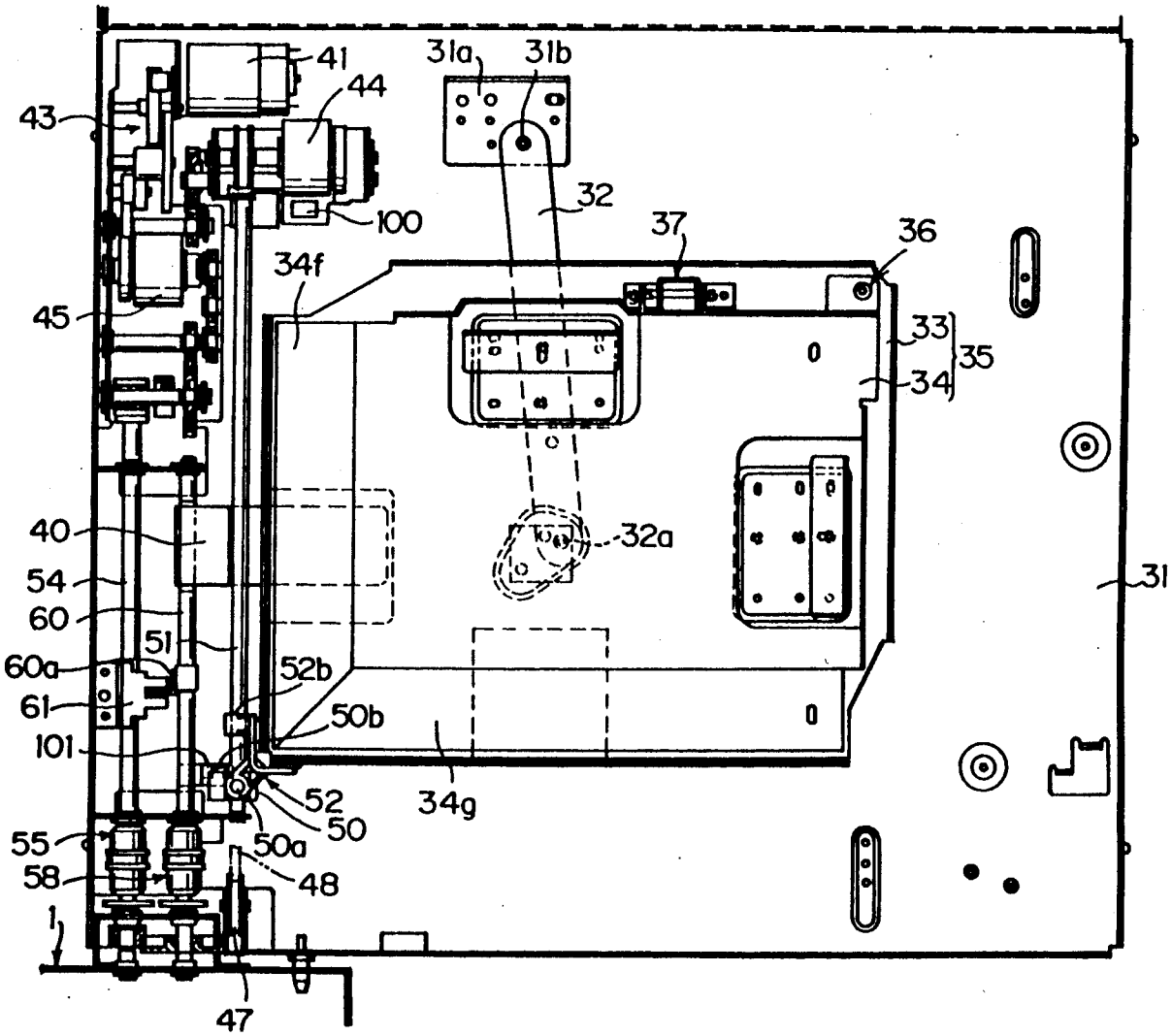

When the driving force of the drive motor 41 is transmitted to the pulley 46 through the first clutch 44, the pulley 46 rotates and the belt 48 starts rotating. Then, as shown in FIG. 3*b*, the moving block 50 fixed to the belt 48 is guided by the guide shaft 51 to move to the other end of the guide shaft 51.

The linear movement of the moving block 50 rotates the rotatable cassette 35 in a direction A. At this time, since the rotatable cassette 35 and the moving block 50 are connected and the moving block 50 linearly moves, the rotation center of the rotatable cassette 35 is moved. This movement is assured by rotating the arm 32, which pivottaly supports the rotatable cassette 35, on its support shaft 31*b* in a direction D. The movement of the arm 32 in the direction D is continued till a line X (see FIG. 3*c*), which links the support shaft 50*a* of the moving block 50 and the support shaft 32*a*, and the guide shaft 51 form an angle of 90°.

Figure 3C:
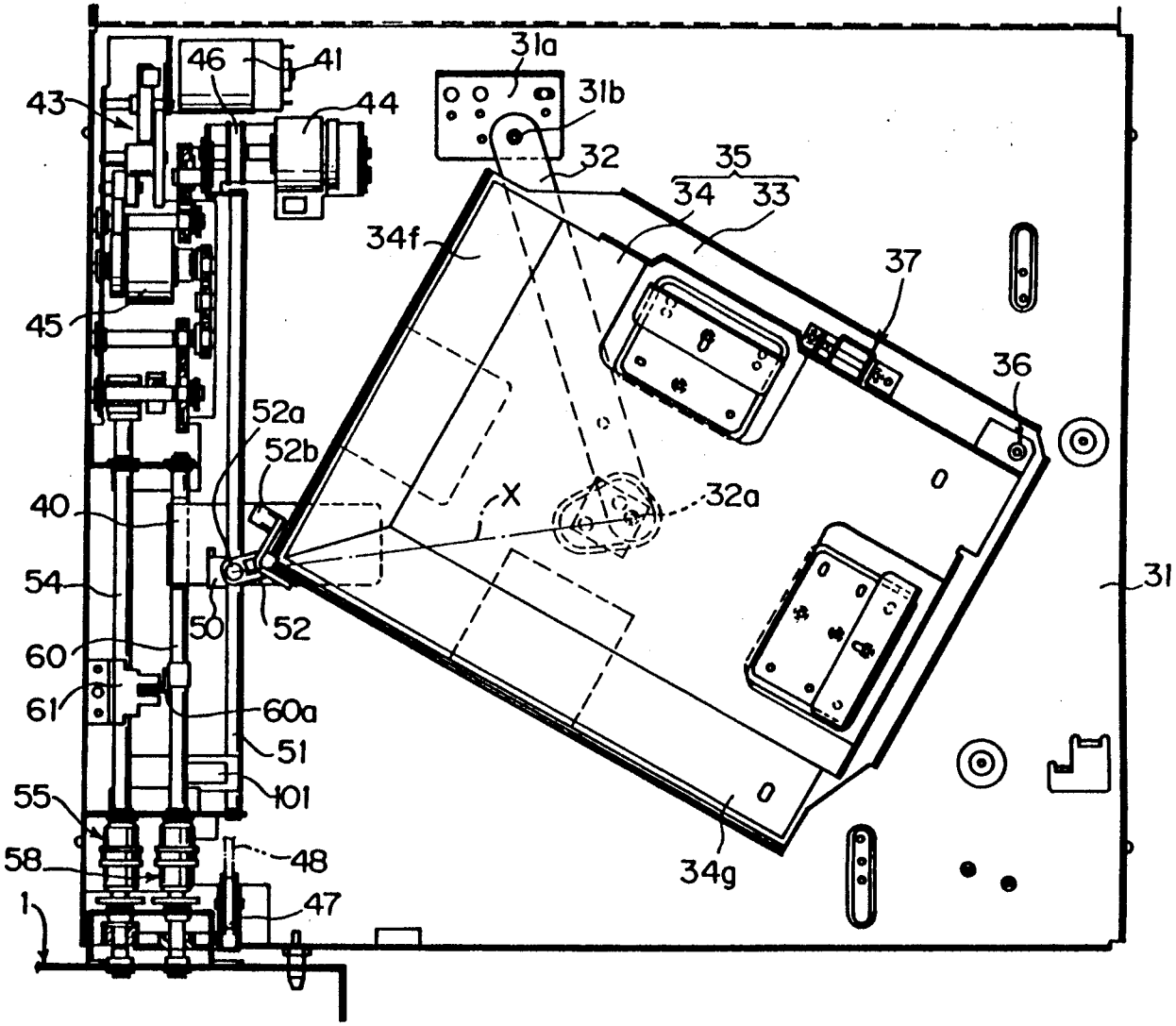
Figure 3D:
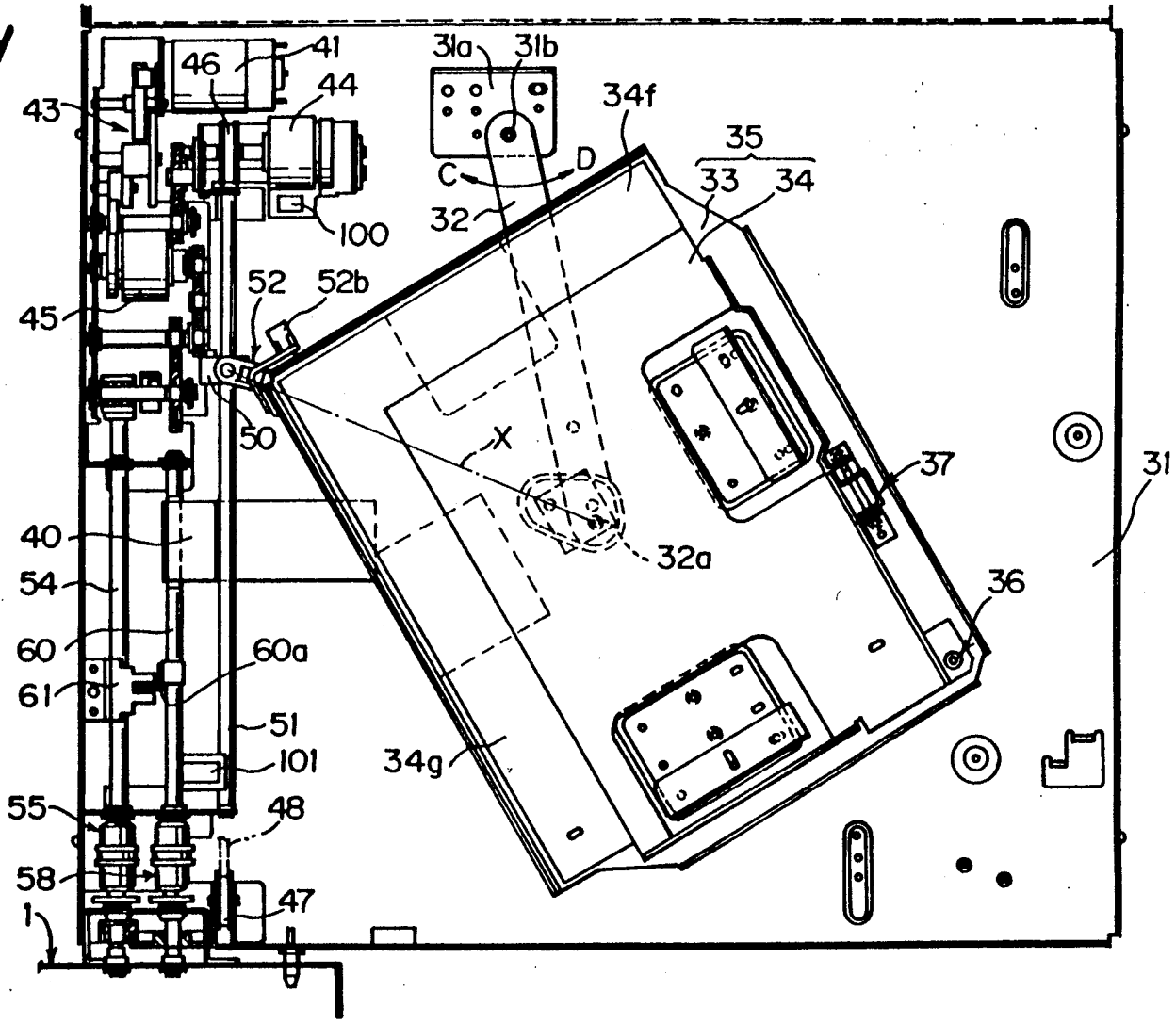

Next, as shown in FIG. 3*c*, when the angle which the above line X and the guide shaft 51 form exceeds 90°, the rotational direction of the rotatable cassette 35 remains in the direction A, while the arm 32 turns in the direction C. Then, as shown in FIG. 3*d*, when the moving block 50 reaches the end of the guide shaft 51, the position detector switch 101 is actuated by the arm 50*b* of the moving block 50. The microcomputer 103 detects the actuation of the position detector switch 101 and intermits the transmission of the driving force by the first clutch 44. Thereby, the moving block 50 is stopped. In this state, the longitudinal feed exit portion of the rotatable cassette 35 faces the side of the sheet exit of the rotatable cassette unit 26(27).

On the other hand, when the rotatable cassette 35 is moved from the longitudinal position to the lateral position, operations reverse to the above-mentioned operations are executed by reversely rotating the drive motor 41. In this case, the arm 52*b* of the hold member 52 actuates the position detector switch 100 the moment the rotatable cassette 35 goes into the lateral position. Then, since the microcomputer 103 detects the actuation of the position detector switch 100 and intermits the transmission of the driving force by the first clutch 44, the moving block 50 is stopped.

Next, the lift-up operation of the sheet exit portion of the rotatable plate 34 and the sheet supply operation by the sheet supply mechanism 62 will be explained.

By the actuation of the second clutch 45 shown in FIG. 2, the driving force of the drive motor 41 is transmitted to the group of gears 53, the rotatable shaft 54, the first coupling 55, the rotatable shaft 56, the rotatable shaft 57, the second coupling 58 and the lift-up shaft 60 in this order. The rotation of the lift-up shaft 60 turns the lift plate 40 (see FIGS. 3*a* to 3*d*, 4*a* and 4*b*). When the lift plate 40 is turned upward, the lift plate 40 passes through the opening 33*c* of the sheet supply base 33, abuts against the bottom plane of the rotatable plate 34 and lifts up the exit portion of the rotatable plate 34. The lift-up enables the sheet supply mechanism 62 to pull the sheets in.

Then, the sheet supply solenoid 73 shown in FIGS. 4*a*, 4*b* and 5 is actuated in response to the sheet supply signal from the microcomputer 103 of the copying machine 1. Thereby, the angle 70 is turned upward by way of the arm 72 and the shaft 71 and released from pressing contact with the projection 68*a* is released. The roller arm 68 descends by means of the rotational force of the belt 67 and the pull-in roller 65 descends. The uppermost sheet on the rotatable plate 34 is pulled to the nip portions of the feed roller 66 and the reverse roller 74 by the rotation of the pull-in roller 65. The sheet pull-in operation of the pull-in roller 65 (its descending state) is continued for a predetermined period when the sheet supply solenoid 73 is operating or till the fed sheet is detected on a predetermined transport path. Furthermore, after the state in which the sheet is pulled in (its ascending state), the pull-in roller 65 also rotates because the feed roller 66 is rotating.

When each of the sheets is pulled in one by one, since the coefficient of friction of the roller surface of the feed roller 66 is bigger than that of the reverse roller 74, each sheet is led toward the supply direction by the feed roller 66. The feed roller 66 and the reverse roller 74 keep on rotating till each of the sheets reaches the next transport roller, and so on.

On the other hand, when two sheets are simultaneously fed (double feeding), the upper sheet of the two sheets is led toward the supply direction by the feed roller 66, while the bottom sheet is prevented from proceeding toward the supply direction by the reverse roller 74. Though the feed roller 66 keeps on rotating till the upper sheet reaches the next transport roller, and so on, since the reverse roller 74 also simultaneously keeps on rotating, the bottom sheet is not transported beyond the nip portions of the rollers 66 and 74. In such a state, a portion of the sheet is left out of the rotatable plate 34.

In the case of multi-sheet supply (the sequential supply of a plurality of sheets), even if the state in which a portion of the subsequent sheet is left out is caused by the double feeding in the middle of the supply operation, it is not so inconvenient. Each of the rollers 65, 66 and 74 keeps on rotating till a predetermined number of sheets are supplied and the plunger 73*a* of the sheet supply solenoid 73 repeats its forward and backward movement a number of times corresponding to the number of the sheets to be supplied.

Figure 7A:
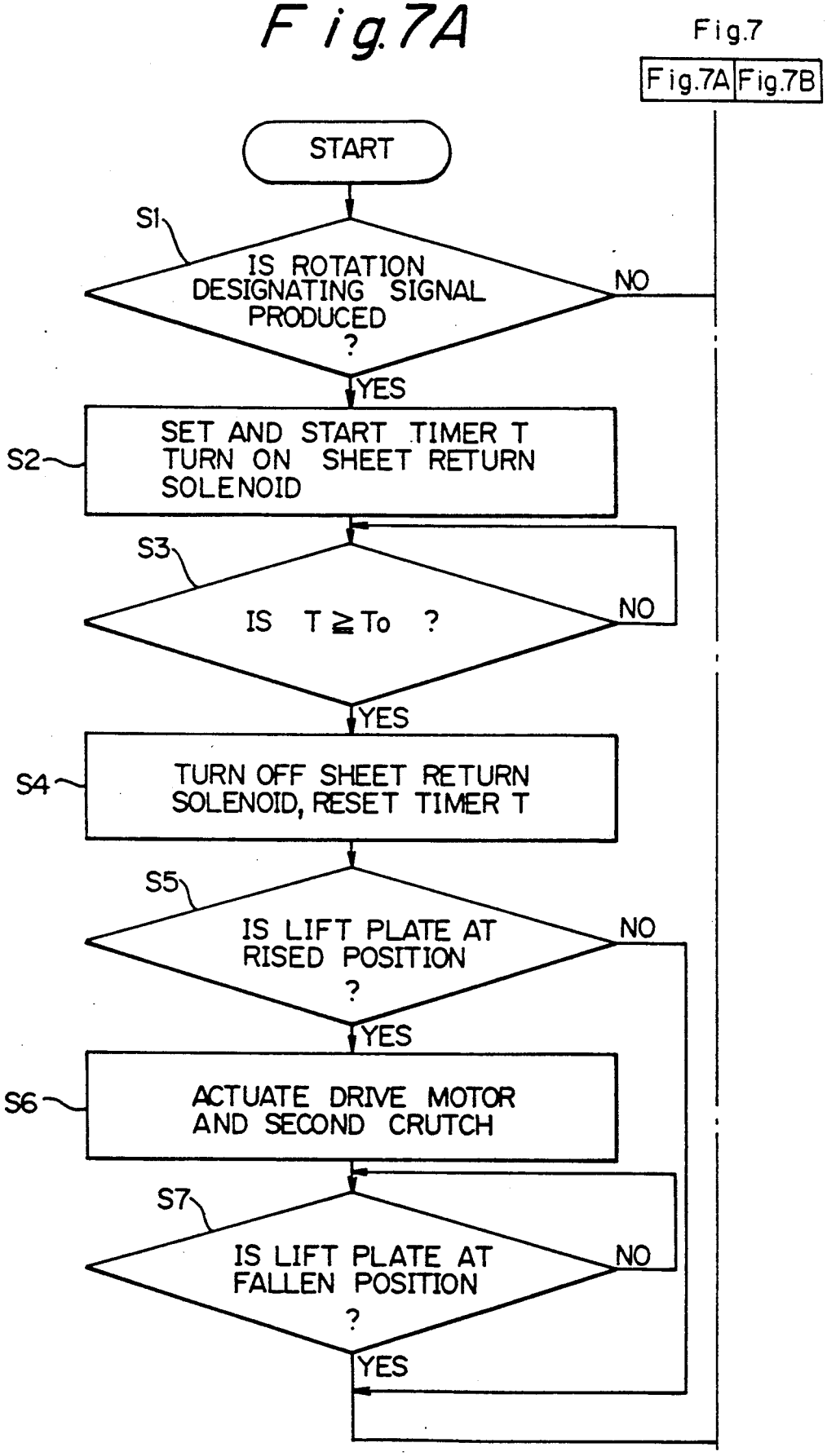
FIG. 7, which is composed of FIGS. 7A and 7B, is a fragmentary diagram of a control program of a microcomputer shown in FIG. 6.
Figure 7B:
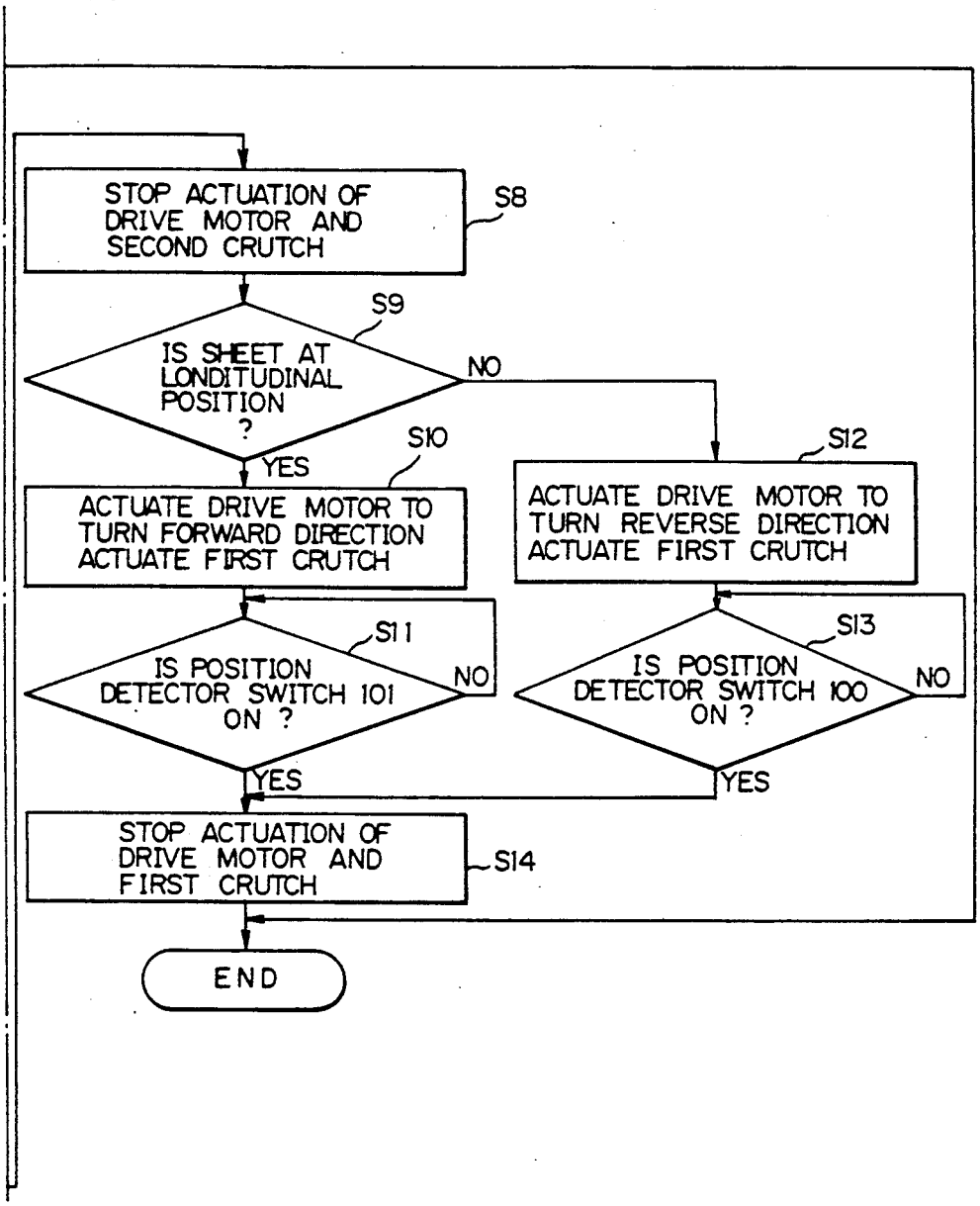

As shown in FIG. 7, after such a series of sheet supply operations are completed, when a rotation designating signal (signal for rotating the rotatable cassette 35) is produced (Step S1), the microcomputer 103 proceeds to Step S2. In Step S2, the timer T is set, the count operation is started, and then the sheet return solenoid 80 is turned ON and its plunger 80*a* is moved backward. Subsequently, it is judged whether or not the timer T is above To in Step S3. If the timer T≧To, the sheet return solenoid 80 is turned OFF and the timer T is reset (Step S4). After the above operations are performed, the sheet, whose portion is in between the nip portions of the rollers 66 and 74, is completely pushed back.

In other words, when the plunger 80*a* of the sheet return solenoid 80 moves backward, as shown in FIG. 4*b*, the connecting member 77 rotates clockwise, in the figure, thus further turning townward the lever 76 connected to one end 77*a* of the connecting member 77, and the reverse roller 74 is separated from the feed roller 66 by the leg 76*a* of the lever 76.

At the same time as the above operations of the connecting member 77, the backward movement of the plunger 80*a* turns the sheet return plate 81 counterclockwise, in the figure, on the shaft 81*a* which is mounted above the pin of the plunger 80*a*.

The sheet, which is prevented from being fed to avoid the double feeding and whose leading edge is left in the nip portions of the rollers 66 and 74, is released from being pressed in response to the separation of the reverse roller 74. Therefore, even if the leading edge of the sheet is nipped between the rollers 66 and 74, it is ensured that the sheet can move freely. Then, when the sheet return plate 81 turns downward, the leading edge of the sheet is pushed toward the rotatable plate 34 by the tongue portion 81*b* of the sheet return plate 81.

Thus, since when the rotation designating signal is produced, the sheet is pushed back in advance to the rotation of the rotatable cassette 35, the sheet is already laid on the rotatable plate 34 in the rotation operation of the rotatable cassette 35. Therefore, it is possible to certainly prevent the sheet from being damaged by the rotation operation and further to avoid the incorrect sheet supply which is caused by the supply of the damaged sheet after the rotation.

As shown in FIG. 7, after the sheet return solenoid 80 is turned OFF in Step S4, it is judged whether or not the lift plate 40 is raised, based on the detection result of the lift detector switch 61 in Step S5. If it is raised, the lift plate 40 is applied with the turning force by the actuation of the drive motor 41 and the second clutch 45 (Step S6), and the downward movement of the lift plate 40 is continued till the lift detector switch 61 is turned ON by the arm 60*a*, that is, till the lift plate 40 falls to a predetermined fallen position (Step S7).

When the lift plate 40 reaches the predetermined fallen position, the actuation of the drive motor 41 and the second clutch is stopped (Step S8). Next, the rotation direction of the rotatable cassette 35 is judged according to the sheet supply direction (Step S9), the drive motor 41 and the first clutch 44 are actuated, and predetermined rotational operations are executed (Steps S10, S11, S12, S13 and S14). The rotational operation of the rotatable cassette 35 is as described above.

In the above-mentioned embodiment, when the rotation designating signal is produced, the return of the sheet is performed in advance to the rotation of the rotatable cassette. The sheet supply device of the present invention may be arranged so that the sheet return signal is output every time each sheet is supplied in a single sheet supply, or every time a predetermined number of sheets are supplied in a multiple sheet supply, the rotation of the rollers 66 and 74 is stopped in response to the signal, and at the same tiem the sheet return solenoid 80 is actuated.

Furthermore, though the sheet supply mechanism is used in the rotatable cassette unit in the above embodiment, it is apparent that the sheet supply mechanism may be similarly used in the fixed cassette unit. It is also apparent that a friction plate may be used instead of the reverse roller 74.

Figure 8A:
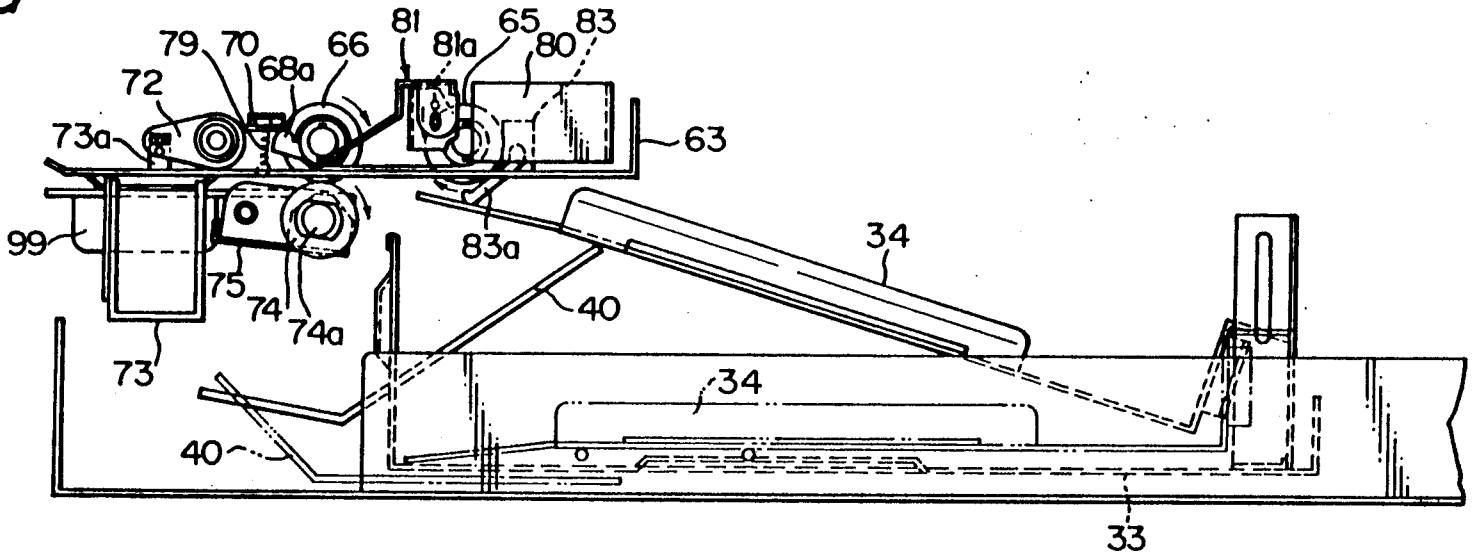
FIGS. 8*a* and 8*b* are schmetatic views of the operation states of a rotatable cassette unit and a sheet supply mechanism in another embodiment of the present invention.
Figure 8B:
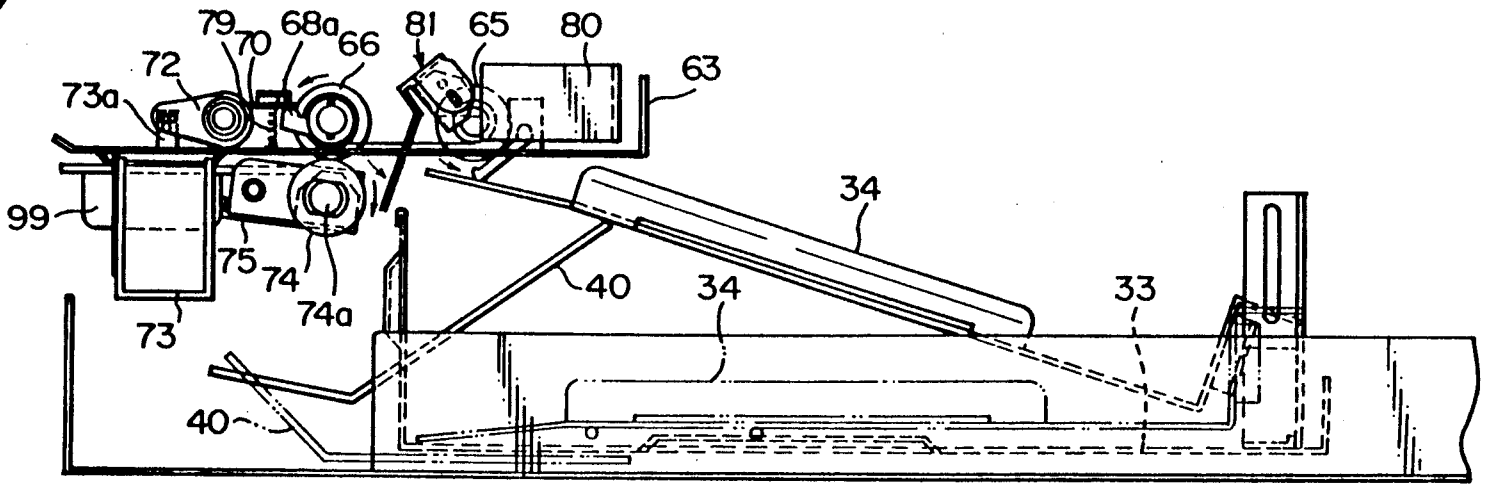
Figure 9:
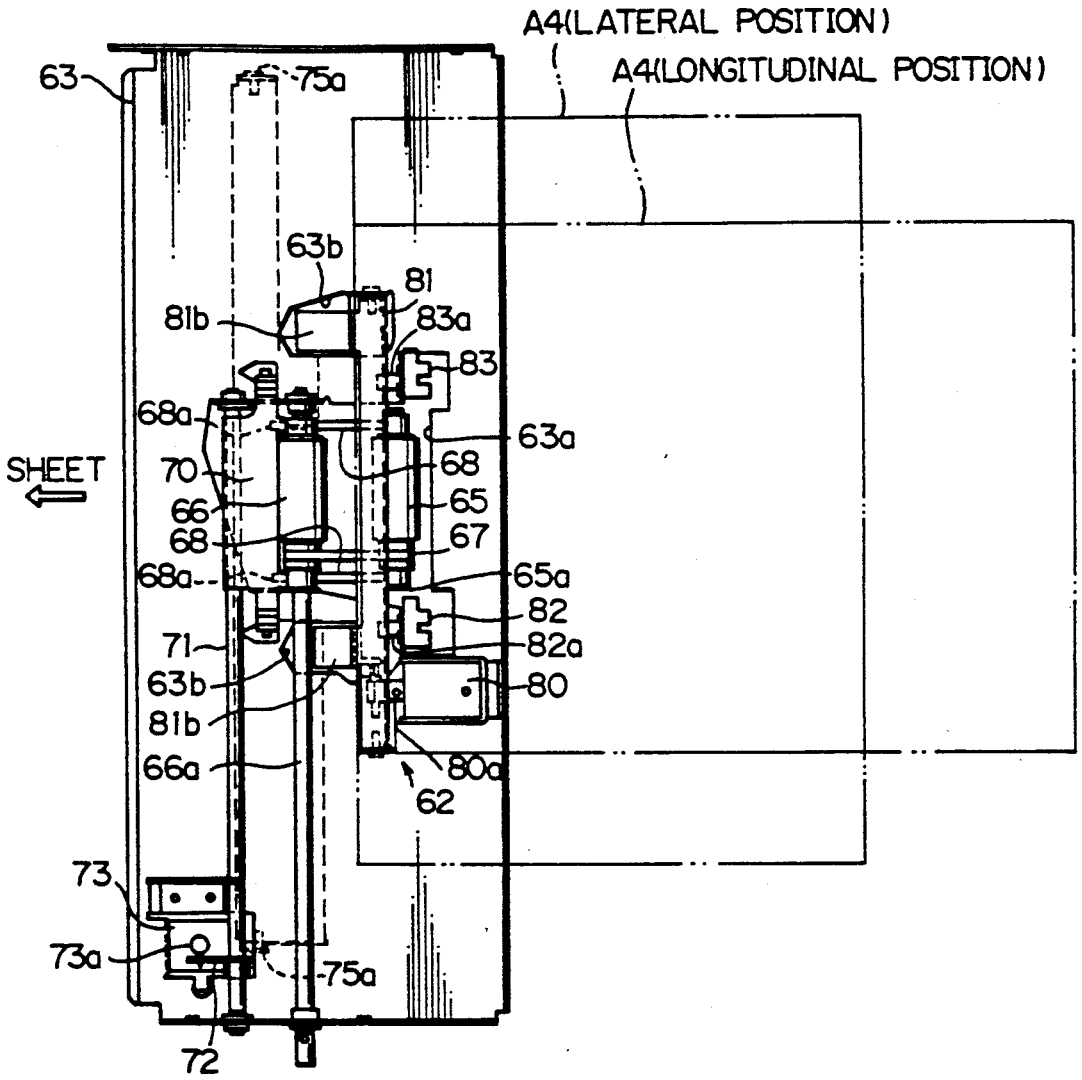
FIG. 9 is a top view of the sheet supply mechanism shown in FIGS. 8*a* and 8*b*.

FIGS. 8*a* and 8*b* are side views respectively showing the operation state of the rotatable cassette unit 26(27) and the sheet supply mechanism 62 mounted above the sheet exit portion of the rotatable cassette unit 26(27) in another embodiment of the present invention and FIG. 9 is a top view of the sheet supply mechanism 62.

In this embodiment, the reverse roller 74 is not separated from the feed roller 66 and both rollers 74 and 66 are always in pressed contact with each other. Therefore, the lever 76 for separating the reverse roller 74 from the feed roller 66 is not mounted. Other arrangement is entirely the same as that of the embodiment shown in FIGS. 4*a*, 4*b* and 5.

In this embodiment, when the sheet is pushed back, both the pull-in roller 65 and the feed roller 66 are rotated in the direction reverse to the normal direction. Furthermore, the sheet return solenoid 80 is actuated to move the plunger 80*a* backward.

When the plunger 80*a* of the sheet return solenoid 80 is moved backward, as shown in FIG. 8*b*, the sheet return plate 81 is turned counterclockwise, in the figure, on the shaft 81*a* mounted above the pin position of the plunger 80*a*.

In addition, the sheet supply solenoid 73 is actuated again for a predetermined period. Thereby, the angle 70 is turned upward through the arm 72 and the shaft 71 and the projection 68*a* is released from being pressed. Then, the roller arm 68 is lowered by the weight of the pull-in roller 65 and makes the pull-in roller 65 abut against the upper plane of the sheet to be returned back.

The sheet, which is prevented from being fed to avoid the double feeding and whose leading edge is left out, is ejected by the reverse rotation of the feed roller 66, even if the leading edge is nipped between the rollers 66 and 74. Then, the sheet return plate 81 is turned downward and the leading edge is pushed back toward the rotatable plate 34 by the tongue portion 81*b* of the sheet return plate 81. Furthermore, since the pull-in roller 65, which is reversely rotating, is abutted against the upper plane of the sheet for a predetermined period by the actuation of the sheet supply solenoid 73, the sheet is more securely returned into the rotatable plate 34.

Thus, since the return operation of the sheet is performed after the sheet supply, the sheet is already laid on the rotatable plate 34 in the rotational operation of the rotatable cassette 35. Therefore, it is possible to certainly prevent the sheet from being damaged by such a rotational operation and further to avoid the incorrect sheet supply which is caused by the supply of the damaged sheet after the rotation.

Though the sheet supply mechanism is used in the rotatable cassette unit in the above embodiment, it is apparent that the sheet supply mechanism may be similarly used in the fixed cassette unit. It is also apparent that a friction plate may be used instead of the reverse roller 74.

Furthermore, though the sheet return operation is preformed by both the sheet return plate 81 and the pull-in roller 65, it is possible to sufficiently achieve the object of the present invention even if only the pull-in roller 65 is used. In other words, since the pull-in roller 65 is reversely rotated for the predetermined period, the sheet, which is pulled out halfway by the rotatable plate 34, is certainly returned into the rotatable plate 34, whether its leading edge is nipped between the rollers 66 and 74 or is on this side of the rollers 66 and 74. In this case, it is possible to certainly return the sheet without using the sheet return plate 81. With using the sheet return plate 81, the certainty is enhanced.

Many widely different embodiments of the present invention may be constructed without departing from the spirit and scope of the present invention. It should be understood that the present invention is not limited to the specific embodiments described in the specification, except as defined in the appended claims.

What is claimed is:

1. A sheet supplying device comprising:

at least one sheet cassette for stacking a plurality of sheets to be fed;

means for rotating said sheet cassette between a longitudinal sheet supply position and a lateral sheet supply position;

means for drawing the sheets out of said sheet cassette to feed the drawn sheet to a predetermined path;

means for returning a sheet into said sheet cassette, said sheet being drawn by said drawing means but stayed in a position that the leading edge thereof is out of said sheet cassette; and means for actuating said return means before rotating said sheet cassette.

2. A device as claimed in claim 1, wherein said device further comprises control means for actuating said return means at each time a predetermined sheet supply operation is completed.

3. A device as claimed in claim 1, wherein said return means includes a sheet return plate for pushing the leading edge of a sheet to push back the sheet into said sheet cassette.

4. A device as claimed in claim 1, wherein said drawing means includes at least one roller capable of being in contact with the upper most sheet of the sheets stacked in said sheet cassette and of rotating in a direction of drawing said contacted sheet out of said sheet cassette.

5. A device as claimed in claim 4, wherein said return means includes means for rotating a reverse roller in a direction opposite to said drawing direction for a predetermined period of time while keeping said reverse roller in contact with said sheet being returned into said sheet cassette.

6. A device as claimed in claim 1, wherein said device further comprises means for stopping the feed of a sheet not to be fed so as to prevent double feeding of the stacked sheets.

7. A device as claimed in claim 6, wherein said device further comprises a feed roller movable between contact and noncontact positions with said stopping means, and drive means capable of driving said feed roller so as to selectively contact with or separate from said stopping means.

8. A device as claimed in claim 7, wherein said device further comprises control means for actuating said sheet return means after said feed roller separates from said stopping means by said drive means.

* * * * *